US007946537B2

(12) United States Patent
Mathews, Jr. et al.

(10) Patent No.: US 7,946,537 B2
(45) Date of Patent: May 24, 2011

(54) HOT RAIL WHEEL BEARING DETECTION SYSTEM AND METHOD

(75) Inventors: Harry Kirk Mathews, Jr., Clifton Park, NY (US); Pierino Gianni Bonanni, Loudonville, NY (US); Benjamin Paul Church, Blue Springs, MO (US); John Erik Hershey, Ballston Lake, NY (US); Brock Estel Osborn, Niskayuna, NY (US); Wolfgang Daum, Erie, PA (US)

(73) Assignee: Progress Rail Services Corp, Albertville, AL (US)

( * ) Notice: Subject to any disclaimer, the term of this patent is extended or adjusted under 35 U.S.C. 154(b) by 198 days.

(21) Appl. No.: 12/122,486

(22) Filed: May 16, 2008

(65) Prior Publication Data

US 2008/0283678 A1 Nov. 20, 2008

Related U.S. Application Data

(60) Provisional application No. 60/938,475, filed on May 17, 2007.

(51) Int. Cl.
*B61K 9/00* (2006.01)

(52) U.S. Cl. ..... 246/169 A; 246/169 D

(58) Field of Classification Search ..... 246/167 R, 246/169 A, 169 D; 250/339.04, 339.05; 340/682; 702/134, 135, 136, 40
See application file for complete search history.

(56) References Cited

U.S. PATENT DOCUMENTS

| | | | | |
|---|---|---|---|---|
| 3,731,087 | A | 5/1973 | King | |
| 3,998,549 | A * | 12/1976 | Pusch et al. | 374/129 |
| 4,313,583 | A | 2/1982 | Bambara et al. | |
| 5,201,483 | A | 4/1993 | Sutnar et al. | |
| 5,331,311 | A | 7/1994 | Doctor | |
| 5,381,700 | A | 1/1995 | Grosskopf, Jr. | |
| 5,448,072 | A | 9/1995 | Gallagher | |
| 5,677,533 | A | 10/1997 | Yaktine et al. | |
| 5,937,070 | A * | 8/1999 | Todter et al. | 381/71.6 |
| 6,815,932 | B2 * | 11/2004 | Wall | 322/20 |
| 6,911,914 | B2 * | 6/2005 | Mathews et al. | 340/682 |
| 2006/0131464 | A1 * | 6/2006 | Hesser et al. | 246/169 D |

* cited by examiner

*Primary Examiner* — Mark T Le

(57) ABSTRACT

A system for detecting a moving hot bearing or wheel is provided. The system includes a summer for combining an input signal representative of radiation emitted by the moving hot rail car bearing with a feedback signal. The system also includes an integrator to accumulate an error resulting from the combination of the input signal and the feedback signal. The system further includes a feedback loop to feedback output of the integrator to the summer.

21 Claims, 14 Drawing Sheets

HOT RAIL WHEEL BEARING DETECTION SYSTEM AND METHOD

CROSS REFERENCE TO RELATED APPLICATIONS

This application is a non-provisional application of the provisional application Ser. No. 60/938,475, filed May 17, 2007, which is herein incorporated by reference.

BACKGROUND

The present invention relates generally to detection of abnormally hot rail car wheel bearing surfaces, and more specifically to signal processing of infrared signals emitted by hot surfaces of such bearings and surrounding structures.

Railcars riding on wheel trucks occasionally develop overheated bearings. The overheated bearings may eventually fail and cause costly disruption to rail service. Many railroads have installed wayside hot bearing detectors (HBDs) that view the bearings and surrounding structure surfaces as a rail car passes, and generate an alarm upon detection of an abnormally hot surface. One of the commonly used techniques includes employing sensors in the HBDs that sense heat generated by the bearing surfaces. For example, pyroelectric sensors may be used that depend upon the piezoelectric effect. However, such sensors can be susceptible to noise due to mechanical motion of the railcars. Such noise may result from so-called microphonic artifacts, and can complicate the correct diagnosis of hot bearings, or even cause false positive readings. In general, false positive readings, although false, nevertheless require stopping a train to verify whether the detected bearing is, in fact, overheating, leading to costly time delays and schedule perturbations.

Accordingly, an improved system and method that would address the aforementioned issues is needed.

BRIEF DESCRIPTION OF THE INVENTION

In accordance with one exemplary embodiment of the present invention, a system for detecting a moving hot bearing or wheel of a rail car is provided. The system includes a summer configured to combine an input signal representative of radiation emitted by the moving hot rail car bearing or wheel with a feedback signal. The system further includes an integrator configured to accumulate an error resulting from the combination of the input signal and the feedback signal. The system also has a feedback loop configured to feedback output of the integrator to the summer.

In accordance with another embodiment of the present invention, a system for detecting a moving hot bearing or wheel of a rail car is provided. The system includes a low pass filter to receive input signals representative of radiation emitted by the moving hot bearing car bearing or wheel and to provide and output signal indicative of temperature state of the bearing or wheel.

In accordance with one embodiment of the present invention, a method for detecting a moving hot bearing or wheel of a rail car is presented. The method includes receiving an input signal representative of radiation emitted by the moving hot rail car bearing or wheel. The method further includes combining the input signal with a feedback signal to generate an error and accumulating the error to produce an output signal. The method also includes feeding back the output signal as the feedback signal for combination with the input signal and determining whether a temperature of bearing or wheel is in excess of a desired value based on the output signal.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
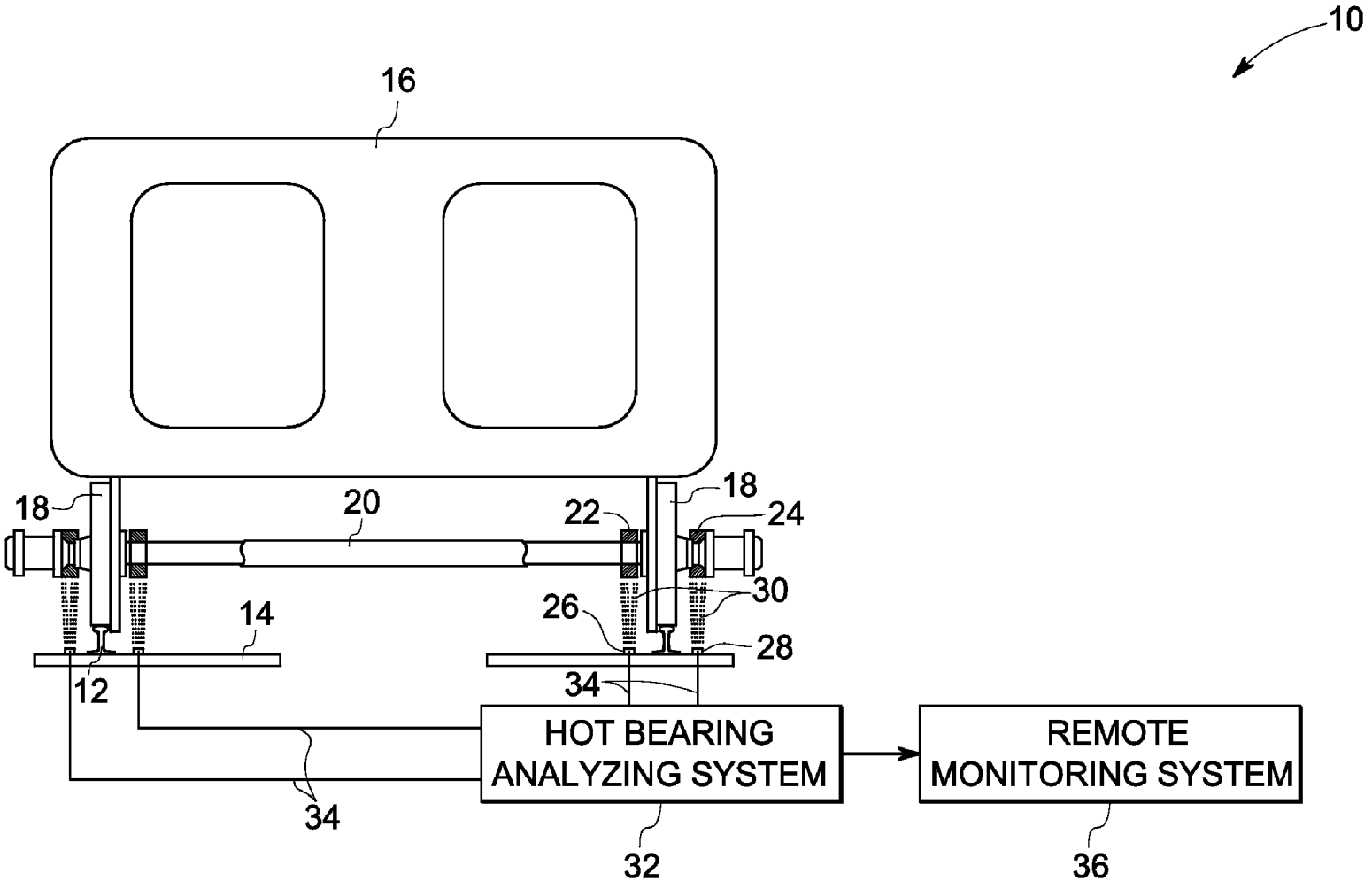
FIG. 1 is a diagrammatical representation of an exemplary system for detecting hot rail car bearings and wheel surfaces.

Referring now to the drawings, FIG. 1 illustrates an exemplary rail car bearing and wheel surface temperature detection system 10, shown disposed adjacent to a railroad rail 12 and a crosstie 14. A railway vehicle or car 16 includes multiple wheels 18, typically mounted in sets or trucks. An axle 20 connects wheels 18 on either side of the rail car. The wheels are mounted on and can freely rotate on the axle by virtue of bearings 22 and 24.

One or more sensors 26, 28 are disposed along a path of the railroad track to obtain data from the wheel bearings. As in the illustrated embodiment, an inner bearing sensor 26 and an outer bearing sensor 28 may be positioned in a rail bed on either side of the rail 12 adjacent to or on the cross tie 14 to receive infrared emission 30 from the bearings 22, 24. Examples of such sensors include, but are not limited to, infrared sensors, such as those that use pyrometer sensors to process signals. In general, such sensors detect radiation emitted by the bearings and/or wheels, which is indicative of the temperature of the bearings and/or wheels. In certain situations, the detected signals may require special filtering to adequately distinguish signals indicative of overheating of bearings from noise, such as microphonic noise. Such techniques are described below.

A wheel sensor (not shown) may be located inside or outside of rail 12 to detect the presence of a railway vehicle 16 or wheel 18. The wheel sensor may provide a signal to circuitry that detects and processes the signals from the bearing sensors, so as to initiate processing by a hot bearing or wheel analyzing system 32. In the illustrated embodiment, the bearing sensor signals are transmitted to the hot bearing analyzing system 32 by cables 34, although wireless transmission may also be envisaged. From these signals, the analyzing system 32 filters the received signals as described below, and determines whether the bearing is abnormally hot, and generates an alarm signal to notify the train operators that a hot bearing has been detected and is in need of verification and/or servicing. The alarm signal may then be transmitted to an operator room (not shown) by a remote monitoring system 36. Such signals may be provided to the on-board operations personnel or to monitoring equipment entirely remote from the train, or both.

Figure 2:
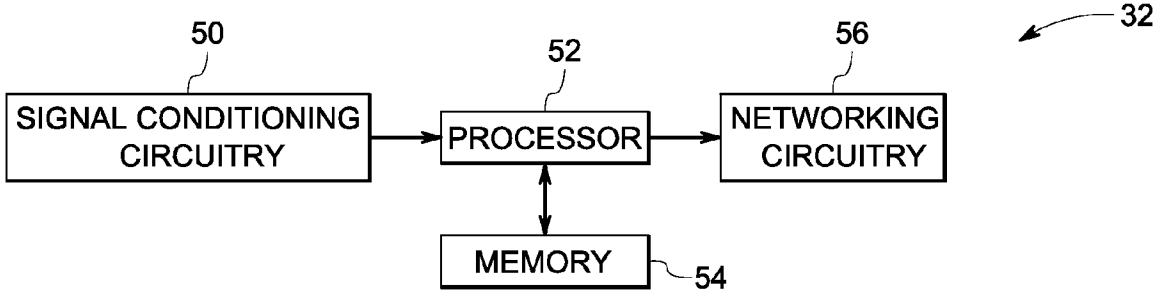
FIG. 2 is a diagrammatical representation of functional components of the hot bearing detection system of FIG. 1.

FIG. 2 is a diagrammatic representation of the functional components of the hot bearing analyzing system 32. The output of inner bearing sensor 26, outer bearing sensor 28 and the wheel sensor are processed via signal conditioning circuitry 50. Signal conditioning circuitry 50 may convert the sensor signals into digital signals, perform filtering of the signals, and the like. It should be noted that the circuitry used to detect and process the sensed signals, and to determine whether a bearing and/or wheel is hotter than desired, may be digital, analog, or a combination. Thus, where digital circuitry is used for processing, the conditioning circuitry will generally include analog-to-digital conversion, although analog processing components will generally not require such conversion.

Output signals from the signal conditioning circuitry are then transmitted to processing circuitry 52. The processing circuitry 52 may include digital components, such as a programmed microprocessor, field programmable gate array, application specific digital processor or the like, implementing routines as described below. It should be noted, however, that certain of the schemes outlined below are susceptible to analog implementation, and in such cases, circuitry 52 may include analog components. In one embodiment, the processor 52 includes a filter to eliminate noise from the electrical signal. In another embodiment, the processing circuitry 52 includes a peak detector for detecting a maximum value of the filtered signal and a comparator for comparing the maximum value of the filtered signal to a predefined threshold to produce an alarm signal.

The processing circuitry 52 may have an input port (not shown) that may accept commands or data required for presetting the processing circuitry. An example of such an input is a decision threshold (e.g., a value above which a processed signal is considered indicative of an overheated bearing and/or wheel). The particular value assigned to any of the thresholds discussed herein may be chosen readily by those skilled in the art using basic techniques of signal detection theory, including, for example, analysis of the sensor system "receiver operating characteristic". As an example, if the system places very high importance on minimizing missed detection (i.e., false negatives), the system may be set with lower thresholds so as to reduce the occurrence rate of missed detections to the maximum tolerable rate. On the other hand, the system thresholds may be set higher so as to reduce the rate of "false positives" while still achieving a desired detection rate, coinciding with maintaining an acceptable level of "false negatives". In general, and as described below, both types of false determinations may be reduced by the present processing schemes. As also described below, the system may implement an adaptive approach to setting of the thresholds, in which thresholds are set and reset over time to minimize occurrences of both false negative and false positive determinations.

When digital circuitry is used for processing, the processing circuitry will include or be provided with memory 54. In one embodiment processing circuitry 52 utilizes programming, and may operate in conjunction with analytically or experimentally derived radiation data stored in the memory 54. Moreover, memory 54 may store data for particular trains, including information for each passing vehicle, such as axle counts, and indications of bearings and/or wheels in the counts that appear to be near or over desired temperature limits. Processed information, such as information identifying an overheated bearing or other conditions of a sensed wheel bearing, may be transmitted via networking circuitry 56 to a remote monitoring system 36 for reporting and/or notifying system monitors and operators of degraded bearing conditions requiring servicing.

Figure 3:
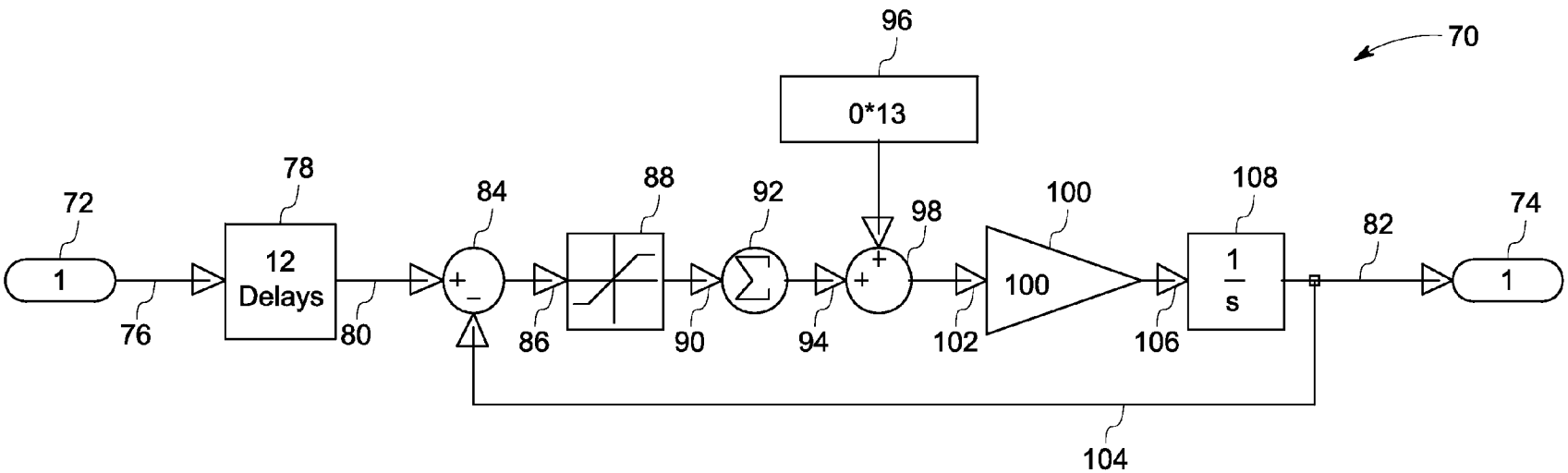
FIG. 3 is a diagrammatic representation of signal processing components for detecting hot rail car bearings and wheels via an approximate rank filter with dynamic sorting and multiple delay block, in accordance with an embodiment of the present invention.

FIG. 3 represents a diagrammatical view of exemplary functional components that may be included in the processing circuitry, either in digital form, analog components, or both. In this embodiment, the components include an approximate rank filter 70 with dynamic sorting and multiple delay block. The filter 70 includes an input port 72 and an output port 74. Input port 72 passes an input signal 76 to a multiple delay block 78. In general, the input signal 76 is a signal from sensors 26, 28 of FIG. 1, which may be filtered or conditioned prior to application to the filter 70. The multiple delay block 78 discretizes input signal 76 in time, and outputs delayed values of input signal 76. The delay block may employ one or more delays, and in the latter case, may use the same or different delay values in parallel. Thus, an output signal 80 of the multiple delay block 78 is a set of the input signal delayed values. An output signal 82 of the filter 70 is subtracted from the output signal of the multiple delay block by a summer 84. The output signal of the multiple delay block is compared to a current estimate of a rank value by a saturation block 88, although a comparator may also be used for this purpose. The filter 70 replaces the set of delayed input signal values by its rank R, where rank R is determined by an offset 96. For example, if the offset 96 is zero then the output signal 82 of the filter 70 is approximately the median value of the delayed signals 80. Thus, the output of this filter is noise-free. An output signal 90 of the saturation block 88 is +1 if the input signal 86 is greater than 1, −1 if the input signal 86 is less than −1 and equal to the input otherwise.

A summer 92 adds these set elements. An output signal 94 of the summer 92 is further added with the offset 96 by a summer 98. The gain block 100 is used to control a speed of convergence and hence the error in an approximation. A gain block 100 further amplifies the sum 102 of all the set elements and the offset 96. The approximation is due to the set of delayed signals continuing to change while a feedback loop 104 (i.e. a sorting algorithm) is converging. In discrete time implementation, the approximation improves as the rate of convergence is increased and if the feedback 104 is allowed to converge at each instant of time then the approach is no longer approximate. An output signal 106 of the gain block 100 is input to an integrator 108. In one embodiment, the gain value in the gain block is 100. The integrator 108 accumulates an error thereby adjusting the rank estimate to drive the sum to a desired rank. The above approximate rank filter 70 may be implemented in the analog domain, or the digital domain, or a combination thereof. It should be noted that the particular order of processing as represented by the components shown in FIG. 3 may be altered, and other components may be included in the overall circuitry, where desired.

Figure 4:
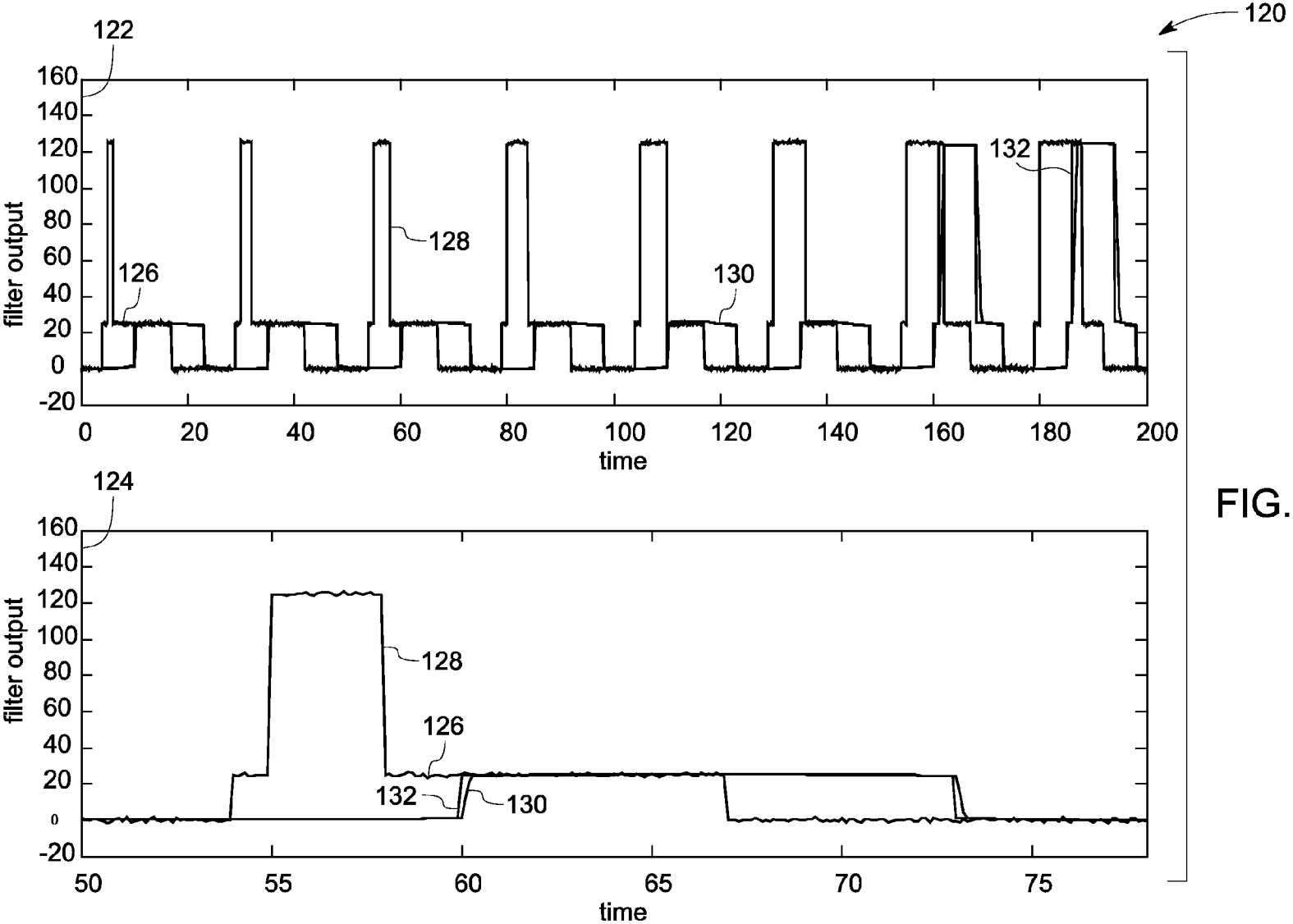
FIG. 4 is an exemplary waveform showing output of the circuitry of FIG. 3.

FIG. 4 represents waveforms 120 processed by the functional circuitry of FIG. 3. In particular, FIG. 4 shows waveforms 122 consisting of a series of pulses processed by the circuitry. Waveforms 124 represent a magnified portion of the waveforms 122. Waveform 126 represents an input signal to the filter 70 of FIG. 3, received from sensors 26, 28 of FIG. 1. The input signal exhibits a signal artifact 128 that is above a decision threshold. Waveform 130 is the output signal of the approximate rank filter 70. The output from the approximate rank filter is free from signal artifact 128 and the resulting maximum filtered value stays well below the threshold. Waveform 132, an output signal from a true rank filter is also plotted in FIG. 4 for comparison. The result of approximate rank filter 70 closely matches that of the rank filter.

Figure 5:
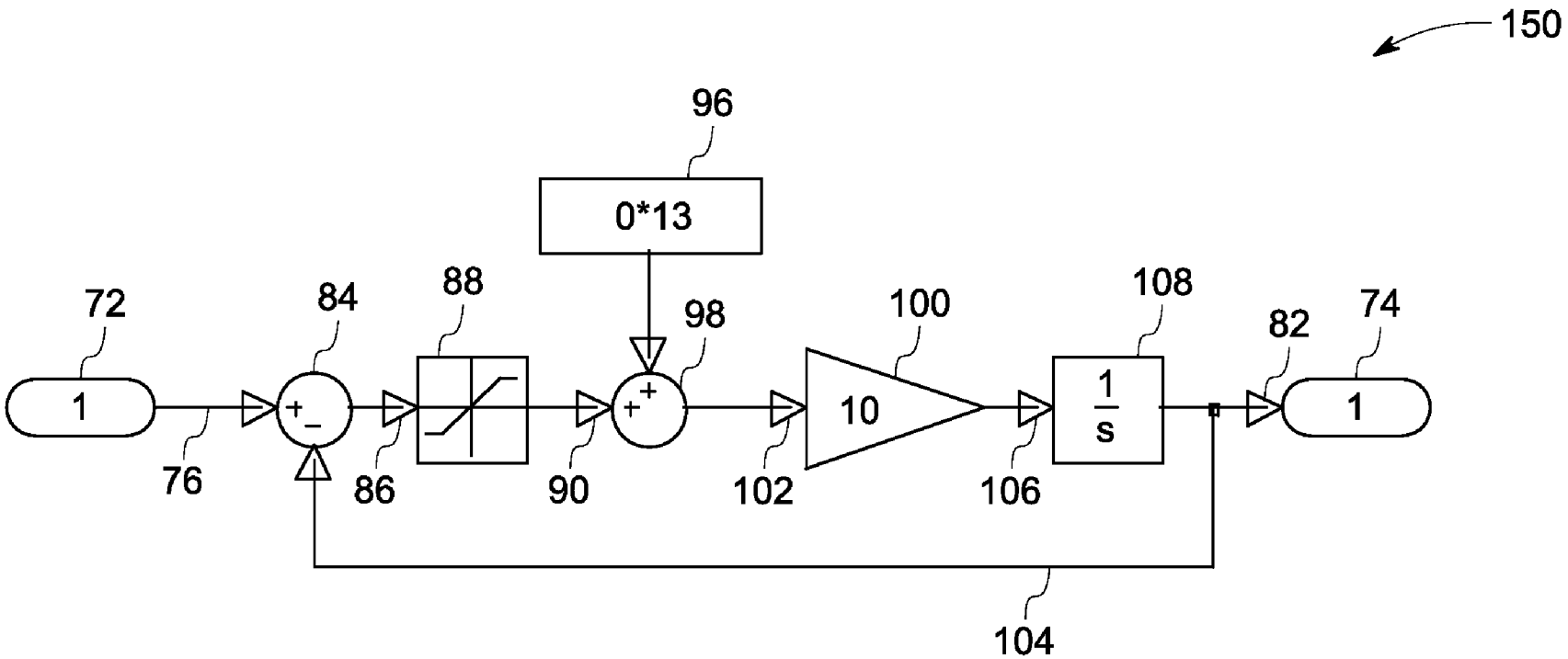
FIG. 5 is a diagrammatical representation of an alternative arrangement for detecting hot rail car bearings and wheels via an approximate rank filter with dynamic sorting and no taps, in accordance with an embodiment of the present invention.

FIG. 5 is a diagrammatical view of another exemplary embodiment for detecting hot rail car bearings and/or wheels via an approximate rank filter 150 with dynamic sorting and no multiple delay block. Filter 150 includes an input port 72 and an output port 74. As described above for filter 70, the filter 150 also replaces each input signal by its rank relative to other values in its neighborhood. However, in this filter the input signal 76 is not delayed as in filter 70. An input signal 76 from the input port 72 is compared to a current estimate of a rank value by a saturation block 88, although a comparator may be used for this purpose, as in the previous embodiment. The output signal 90 of the saturation block 88 is added with the offset 96 by summer 98. Offset 96 sets rank of the approximate rank filter 150. For example, offset of zero results in 50% rank in the filter 150, as in the filter 70 of FIG. 3. A gain block 100 amplifies the output of the summer 98. In one embodiment, the gain value in the gain block is 10. An output signal 106 of the gain block 100 is input to an integrator 108. Finally, an output 82 of the integrator is an accumulation of an error, thereby adjusting the rank estimate to drive the sum to a desired rank.

Figure 6:
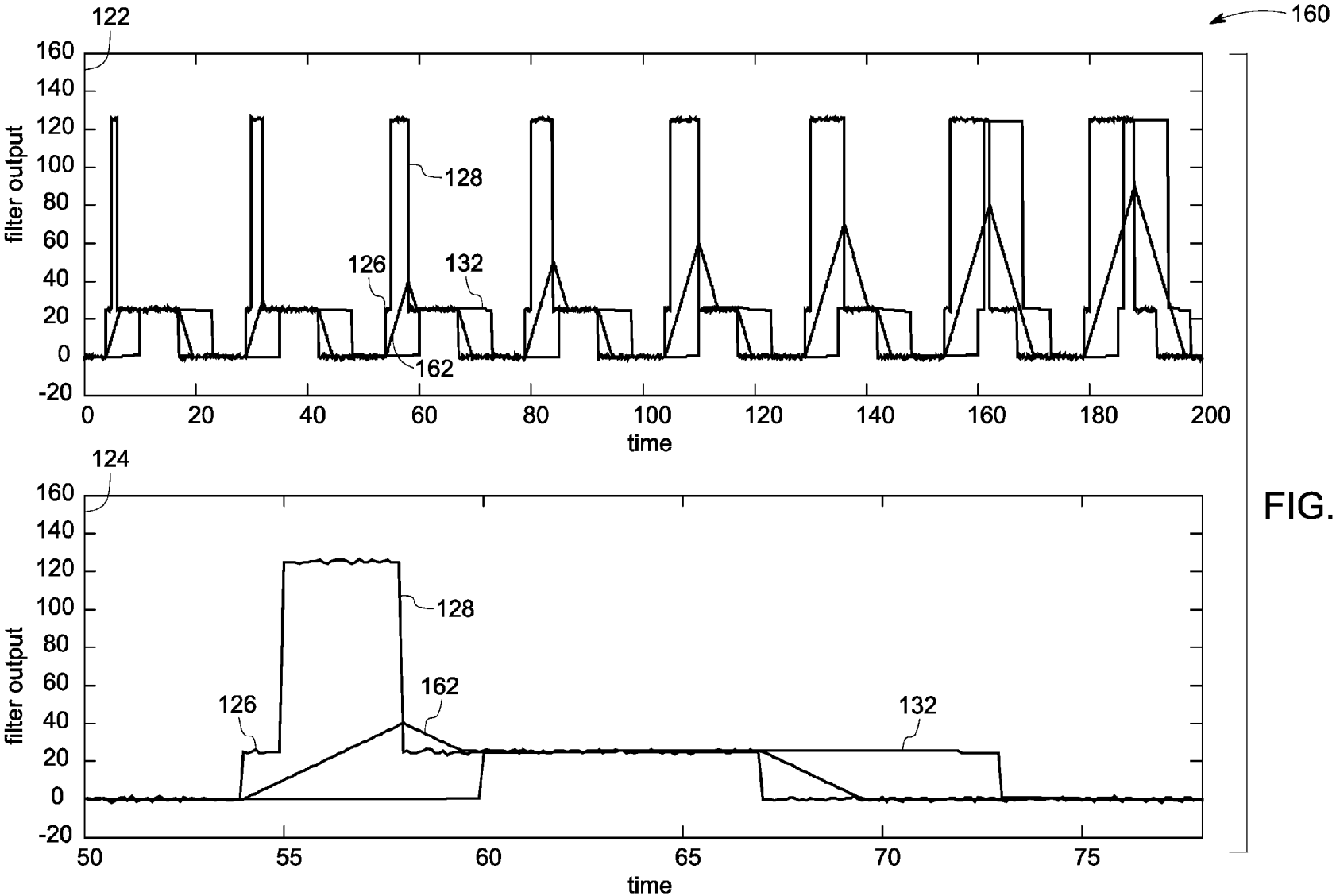
FIG. 6 is an exemplary waveform showing output of the circuitry of FIG. 5.

The waveforms 160 processed by filter 150 are shown in FIG. 6. Waveform 128 is the input waveform received by the filter, while waveform 162 is the output waveform signal of the approximate rank filter 150 of FIG. 5. Here again, waveforms 124 are magnified versions of waveforms 122. The original input waveform exhibited a signal artifact 128 in the illustrated example, while the output waveform 162 is free of the artifact, and generally matches the output signal waveform 132 of a rank filter.

Figure 7:
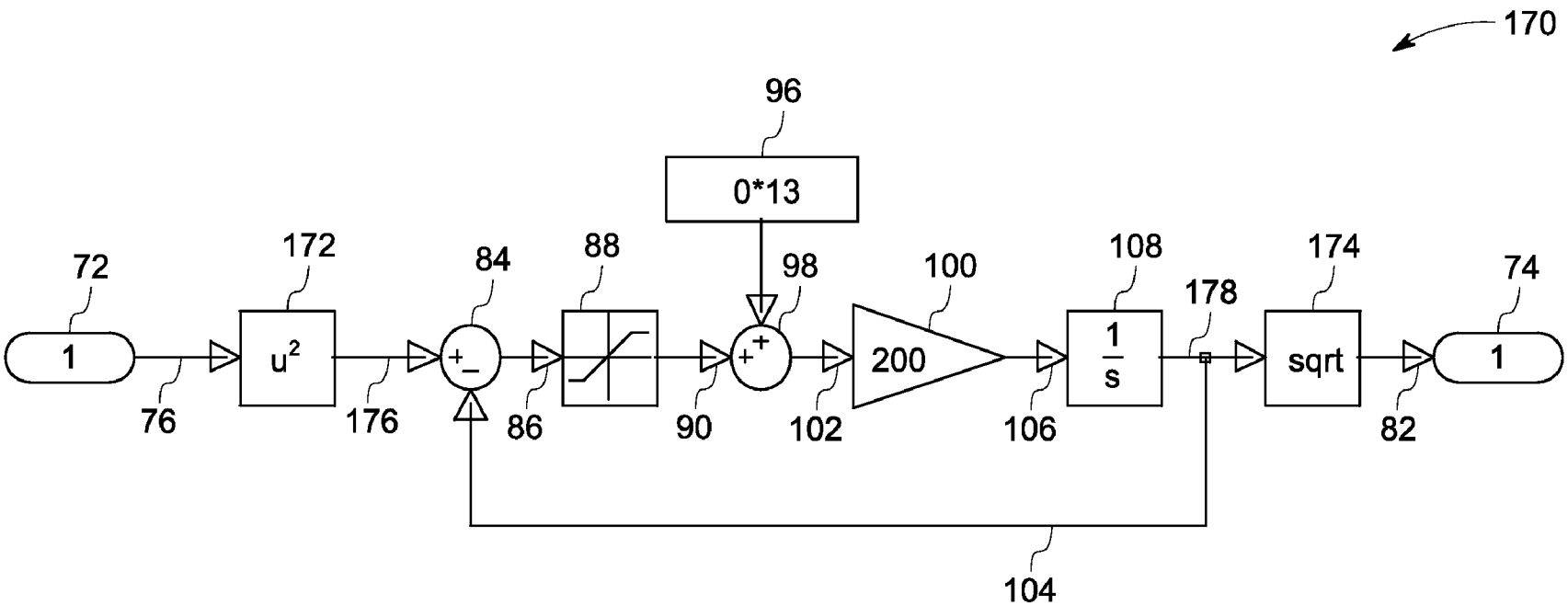
FIG. 7 is a diagrammatical representation of a further alternative arrangement for detecting hot rail car bearings and wheels via a non-linear filter with dynamic sorting and no taps, in accordance with an embodiment of the present invention.

FIG. 7 diagrammatically represents another exemplary embodiment for detecting hot rail car bearings and/or wheels via a non-linear filter 170 with dynamic sorting and no multiple delay block. In this embodiment, the filter includes an input port 72, an output port 74, a first non-linear function block 172, a saturation block 88, a gain block 100, an offset 96, an integrator 108 and a second non-linear function block 174. In some instances the filters 70, 150 do not offer acceptable performance, such as when noise in the input signal 76 is non-additive or is non-Gaussian. In such instances, the non-linear filter 170 may provide better results. The input signal 76 of the filter 170 is also an input to the first non-linear function block 172. An output 176 of the first non-linear function block 172 is compared to a current estimate of a rank value by the saturation block 88. The offset 96 is added to an output 90 of a saturation block 88. A gain block 100 further amplifies an output 102 of the summer 98. An output signal 106 of the gain block 100 is then input to an integrator 108. An output 178 of the integrator 108 is accumulation of an error. The output signal 178 of the integrator is further input to a second non-linear function block 174. Output port 74 outputs the output signal 82 of the second non-linear function block 174. In one embodiment, the first non-linear function block may be a square function. In another embodiment, the second non-linear function block may be a square-root function.

Figure 8:
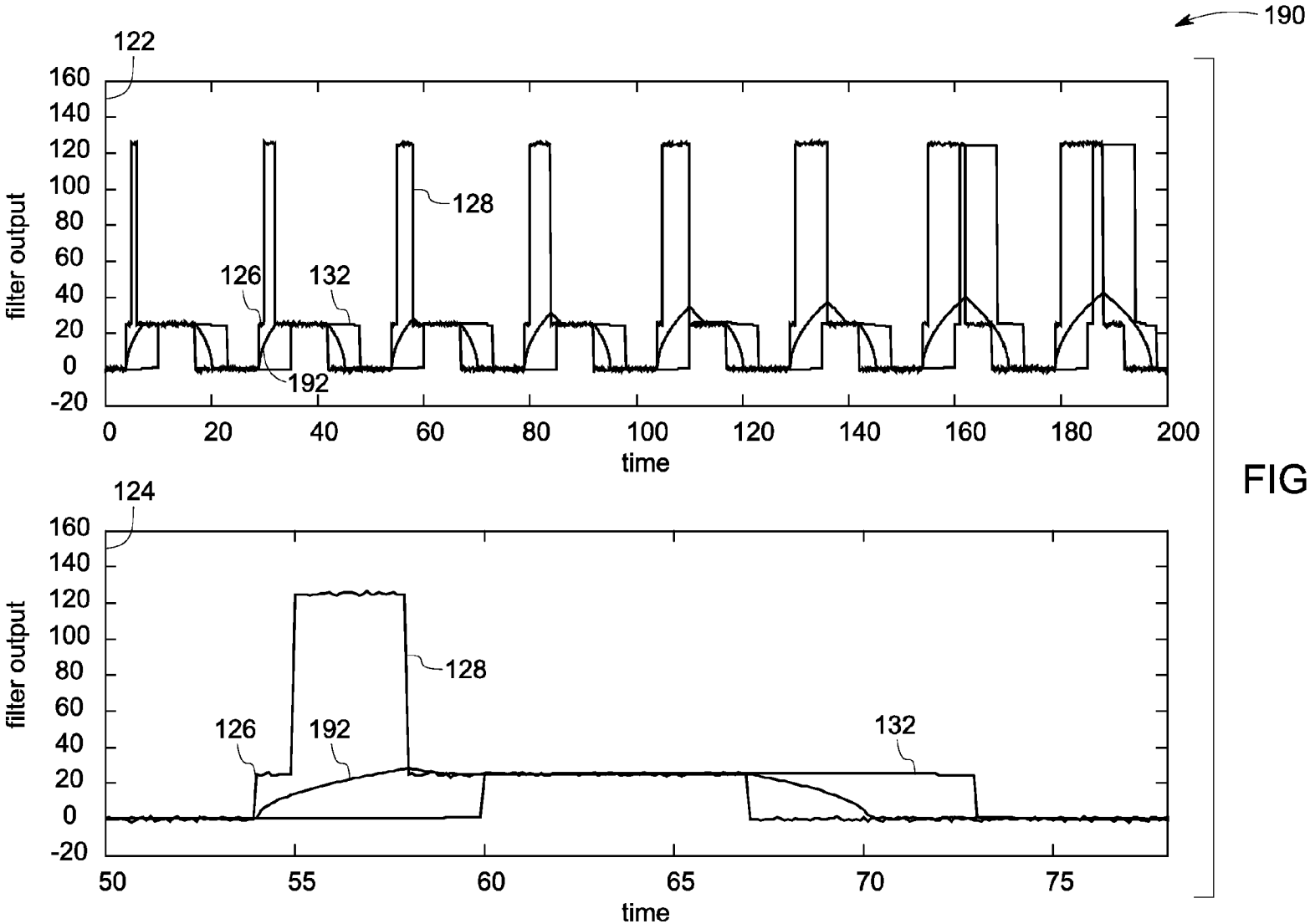
FIG. 8 is an exemplary waveform showing output of the circuitry of FIG. 7.

FIG. 8 represents waveforms 190 processed by the non-linear filter 170. Here again, the waveforms 124 are magnified versions of the waveforms 122. Also, as before, input waveform 126 exhibits signal artifact 128, essentially eliminated by the filter 170, as illustrated by the trace of the output waveform 192.

Figure 9:
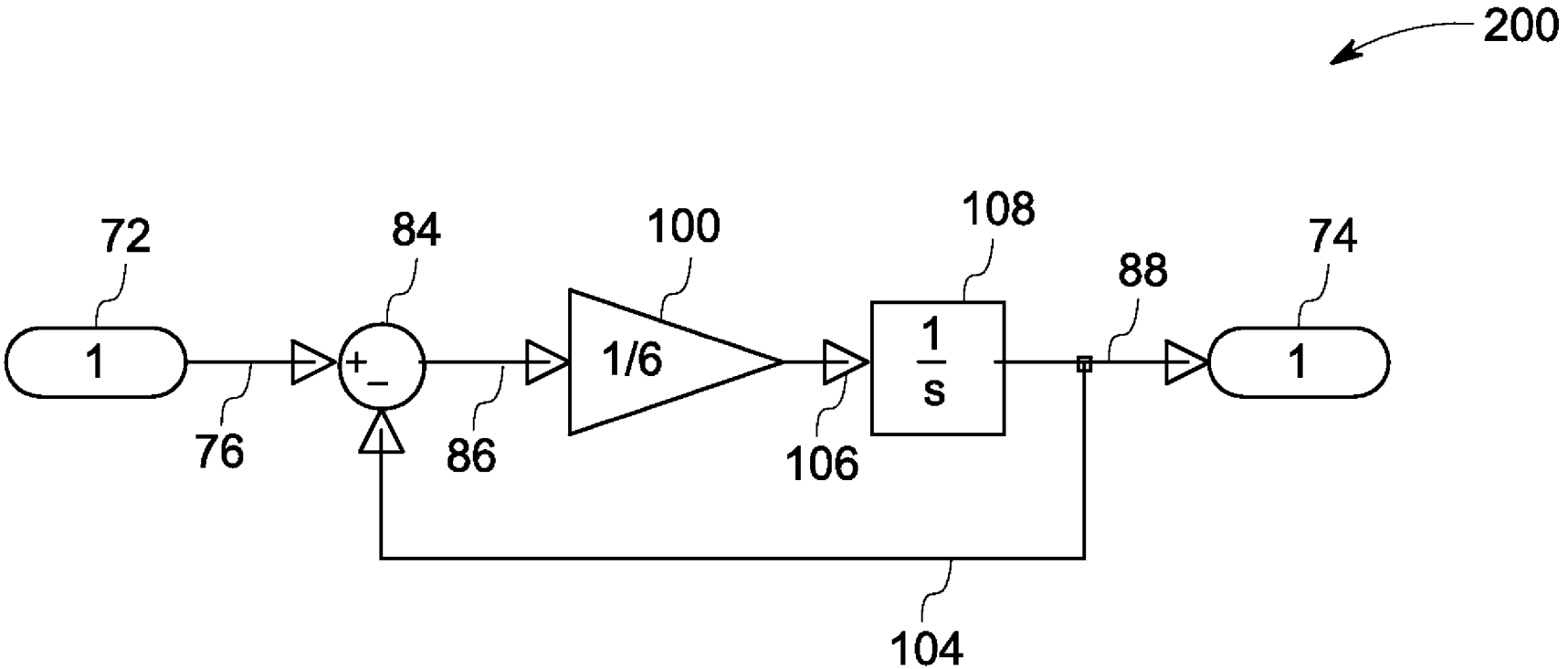
FIG. 9 is a diagrammatical view of another alternative arrangement for detecting hot rail car bearings and wheels via a low pass filter.

FIG. 9 is a diagrammatical representation of another exemplary embodiment for detecting hot rail car bearings and/or wheels via a low pass filter 200. The low pass filter removes signal artifacts from signals received from the hot rail car detection sensors. Here again, the components illustrated may be implemented in the analog domain or the digital domain, or a combination of both. The filter 200 includes a summer 84, a gain block 100 and an integrator 108. The low pass filter 200 passes low frequency signals from the input signal 76 to the output port 74 and blocks high frequency signals. A transfer function of the low pass filter 200 is given by:

$$\frac{1/\tau \cdot s}{1/\tau \cdot s + 1}; \tag{1}$$

wherein s is a Laplace transform operator and $\tau$ is a filter time constant. In Eq. (1) $1/\tau s$ is the gain of forward path of the filter 200. It is represented by the gain block 100 and the integrator 108 in FIG. 9. In the exemplary low pass filter of FIG. 9, the filter time constant $\tau$ is 6. The output signal 82 of the filter fed back via the feedback loop 104 and is subtracted from the input signal 76 by summer 84. The gain block 100 amplifies the output signal 86 of the summer. The output signal 106 of the gain block is then transmitted to the integrator 108. The output of the integrator is then the output of the filter. As will be appreciated by those skilled in the art, any higher order filter may also be used in another embodiment.

Figure 10:
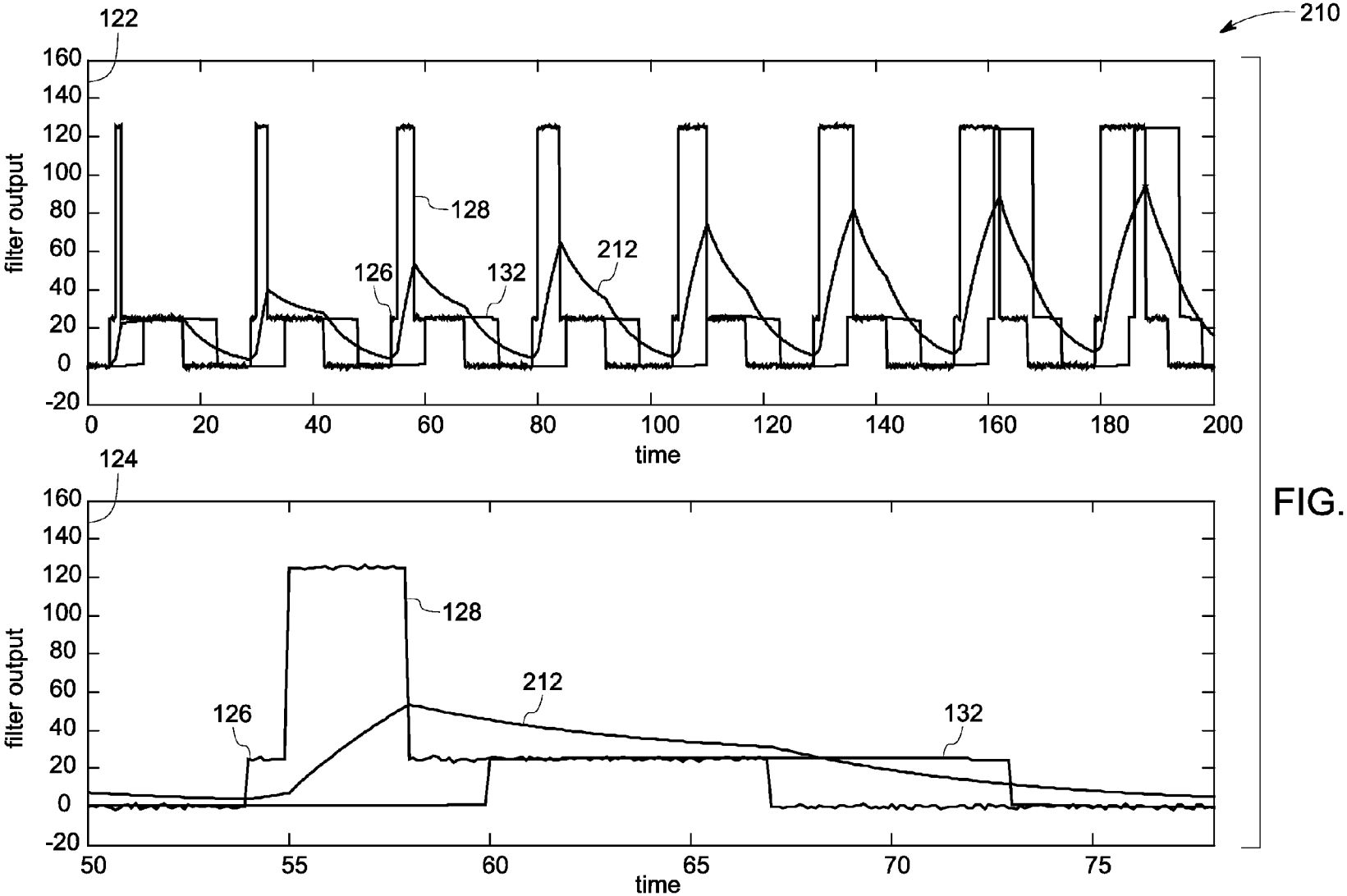
FIG. 10 is an exemplary waveform showing output of the circuitry of FIG. 9.

The waveforms 210 processed by the filter 200 are illustrated in FIG. 10. Here again, waveforms 124 are magnified versions of waveforms 122. Also, the artifact 128 is illustrated in the input waveform 126, but is essentially removed from the output waveform 212.

Figure 11:
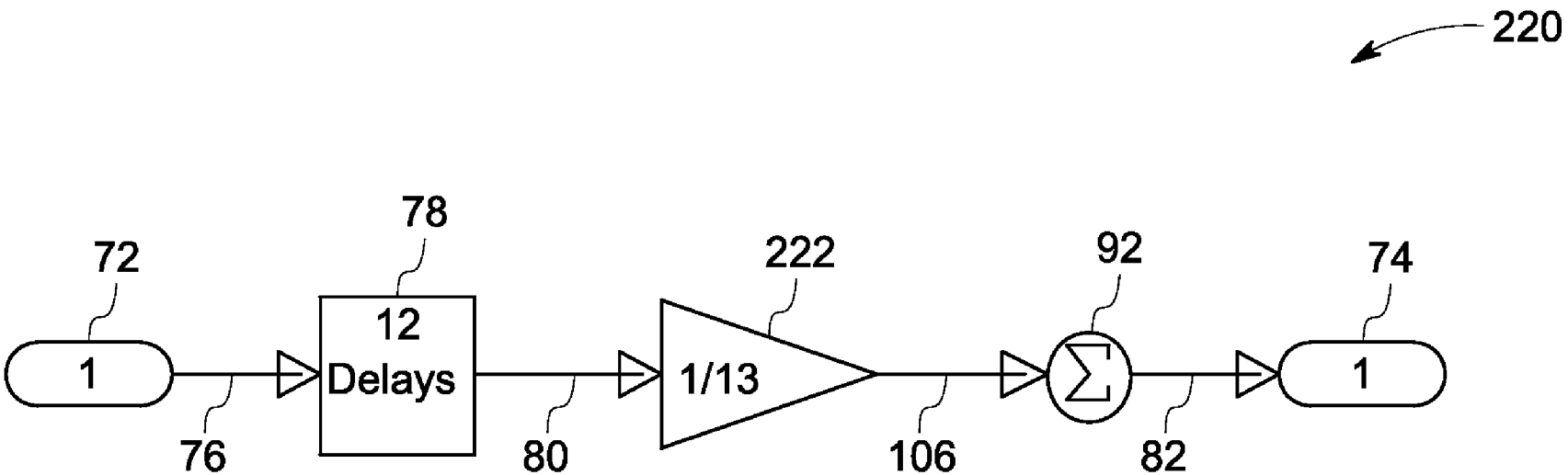
FIG. 11 is a diagrammatical view of another alternative arrangement for detecting hot rail car bearings and wheels via a moving average filter.

FIG. 11 is a diagrammatical representation of another exemplary embodiment for detecting hot rail car bearings and/or wheels via a moving average filter 220. This embodiment includes a multiple delay block 78 outputting multiple delayed values of the input signal, scalar weights 222 and a summer 92. Here again, the components illustrated may be implemented via analog or digital elements, or both. The moving average filter averages a number of input samples 80 and produces a single output sample 82. The averaging action removes the high frequency components present in the input signal 72. The equation of the moving average filter is given by:

$$y[i] = \frac{1}{M}\sum_{j=0}^{M-1} x[i+j] \quad (2)$$

wherein y[i] is the delayed output signal 82 at an instant i, x[i] is the delayed input signal 72 at an instant i. The multiple delay block 78 discretizes input signal 76 in time and outputs delayed values of input signal 76. In Eq. (2), M is a number of points in the average. In present embodiment, value of M is given by the scalar weights 222. In a presently contemplated embodiment, or example, the output 80 of multiple delay block 78 is an array of input signal 76 and twelve delayed signals, such that the average is of 13 samples, although any suitable number may be used. It is then transmitted to the scalar weights 222. The scalar weights and so the averaging points M are selected to maximize the input signal-to-noise ratio. The summer 92 is used for summation of all input signals. It should be noted that other implementations of filter 220 are possible by including some new components or by eliminating some of the existing components. Similar to other filters, moving average filter 220 may also be implemented in the analog domain, or the digital domain, or a combination thereof. In analog implementation an integrator may be used for summation of delayed input signals.

It should be noted that the filters summarized in FIGS. 9 and 11 are averaging or low pass filters, and such average computations may use delayed signal values that are summed and integrated. Such moving average and low pass filters may function well to remove certain types of noise, such as impulse noise, and less well on other types of noise (e.g., signals created by sunshine on the sensors between rail cars). Moreover, low pass filters used may include either finite or infinite response filters. Higher order low pass filters may also be employed, such as filters having more integration blocks, additional feedback loops, and so forth.

Figure 12:
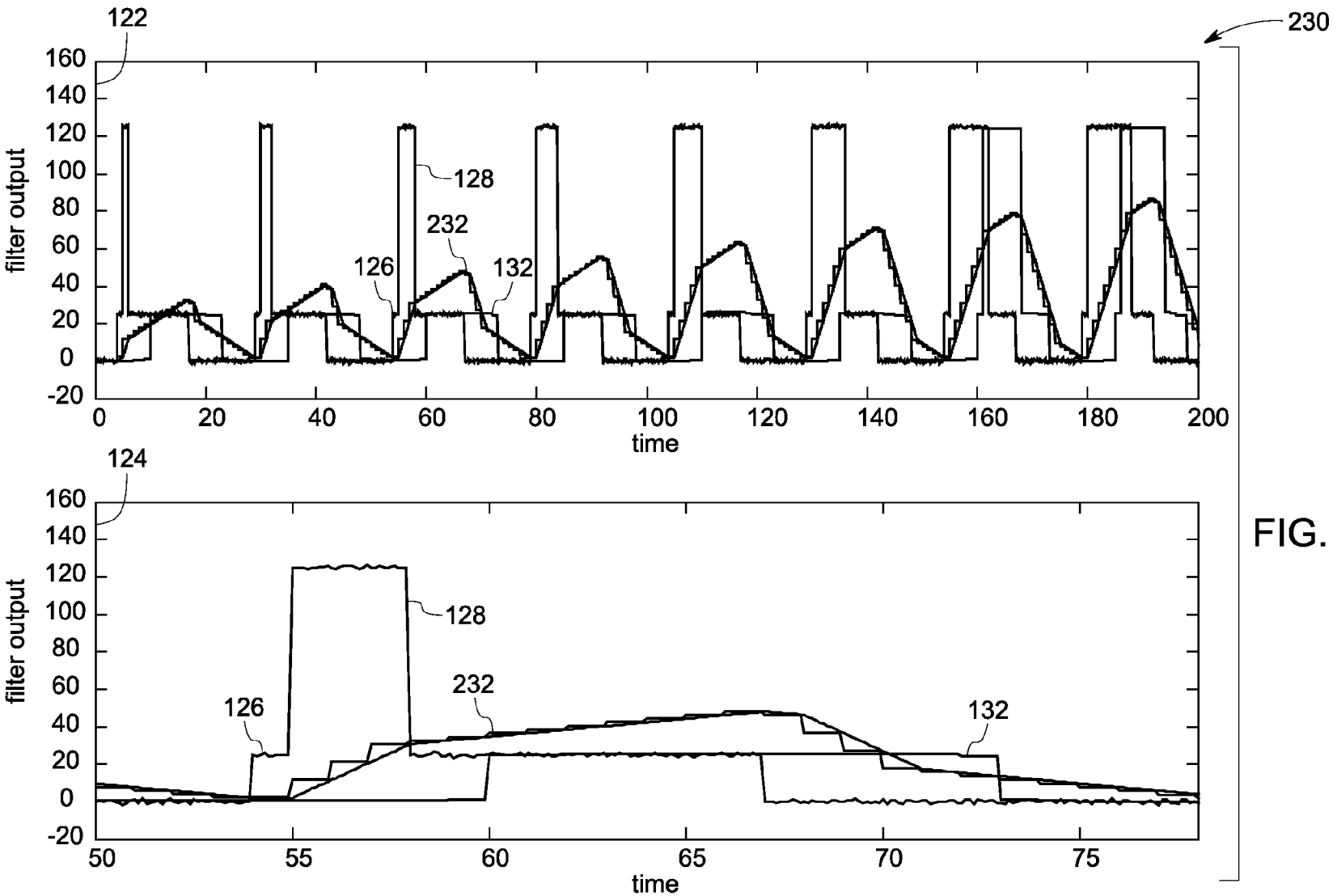
FIG. 12 is an exemplary waveform showing output of the circuitry of FIG. 11.

FIG. 12 represents waveforms 230 processed by the moving average filter. Again, waveforms 124 are magnified versions of waveforms 122. Artifact 128 can be seen in the input waveform 126, but is essentially removed from the output waveform 232.

Figure 13:
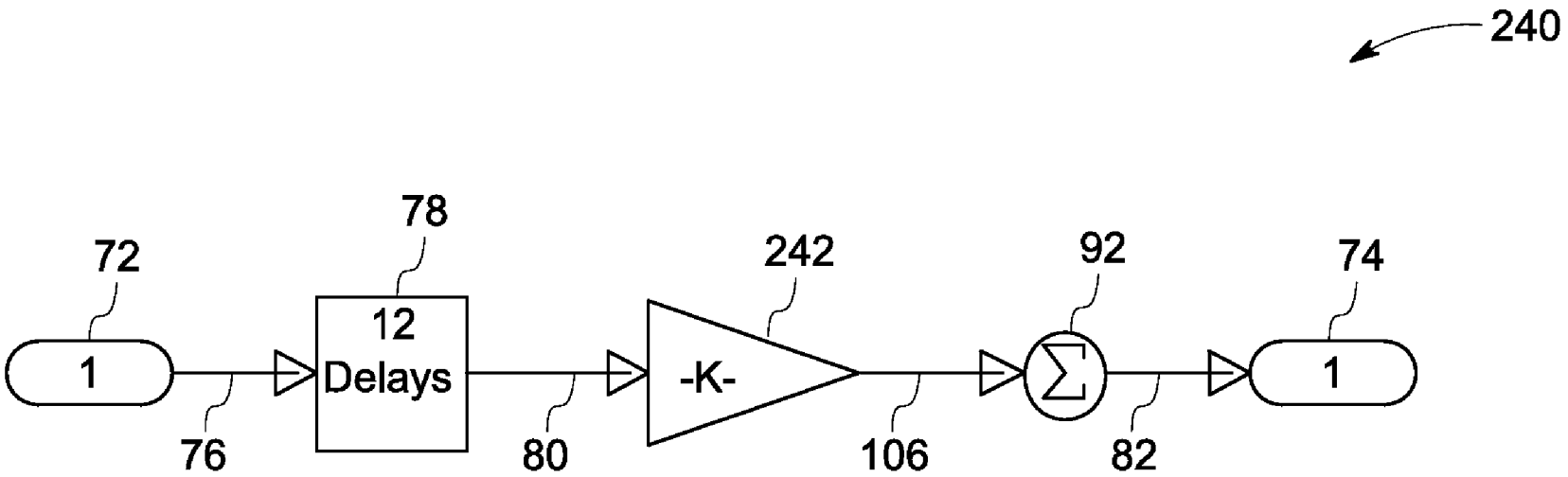
FIG. 13 is a diagrammatical view of another alternative arrangement for detecting hot rail car bearings and wheels via a weighted moving average filter.

FIG. 13 illustrates another exemplary embodiment for detecting hot rail car bearings and/or wheels via a weighted moving average filter 240. The difference between moving average filter 220 of FIG. 11 and weighted moving average filter 240 is that set of weights 242 is used in weighted moving average filter rather than scalar weights 222 as used in moving average filter 220. The set of weights 242 are chosen to shape the frequency response of the filter 220 to best reject undesired artifacts and/or noise.

Figure 14:
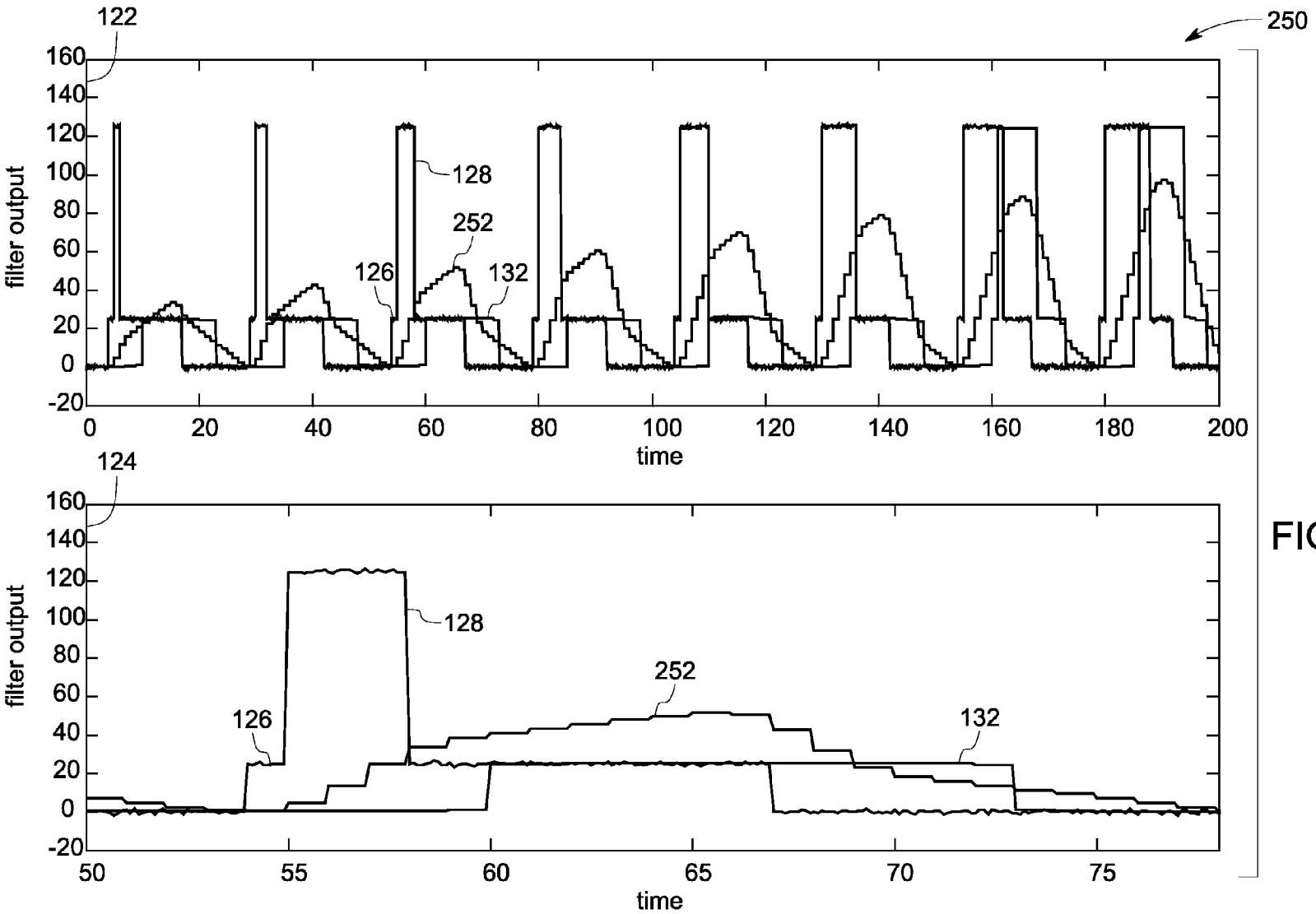
FIG. 14 is an exemplary waveform showing output of the circuitry of FIG. 13.

FIG. 14 represents waveforms 250 processed by the filter of FIG. 13. Again, the waveforms 124 are simply magnified portions of waveforms 122. Also, here again, artifact 128 can be seen in the input waveform 126, but is essentially removed from the output waveform 252.

Figure 15:
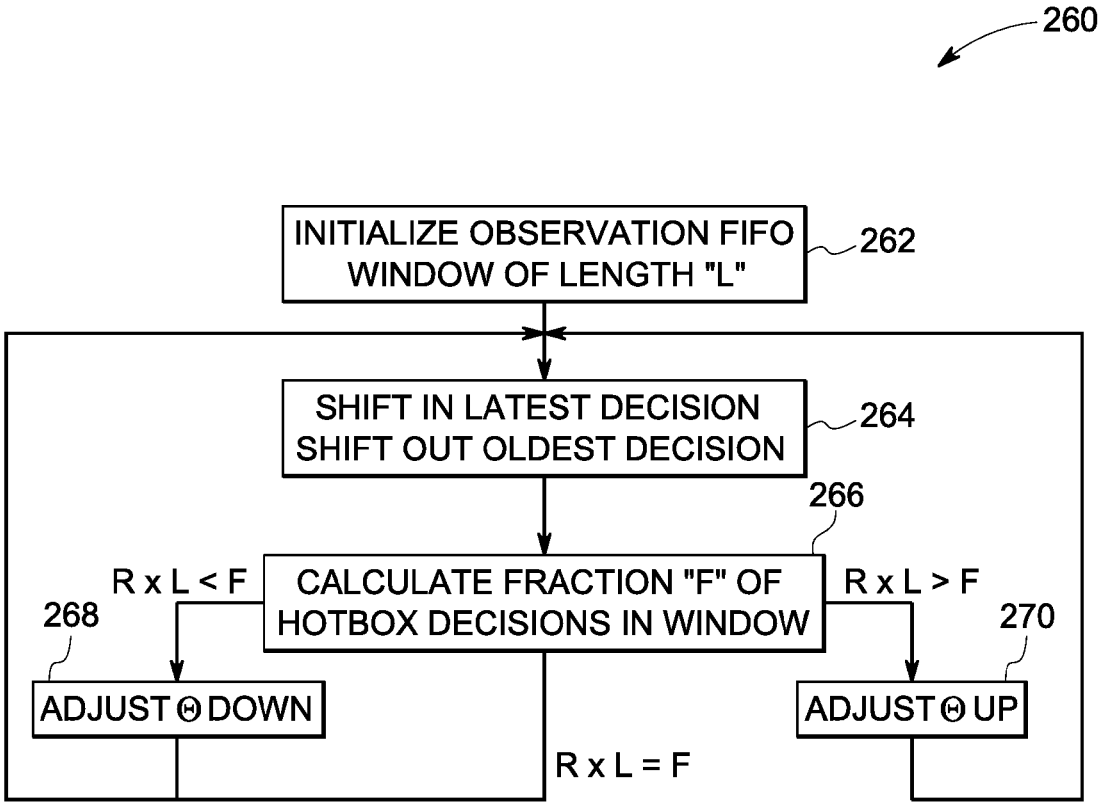
FIG. 15 represents a decision threshold adjustment algorithm in accordance with an embodiment of the present invention.

FIG. 15 represents the decision threshold adaptive algorithm 260. A first in first out (FIFO) window of length L is initialized at start in step 262. The FIFO window of length L contains the decisions regarding the differentiation of abnormally hot rail car surfaces/normally hot rail car surfaces. In step 264, old values of threshold are removed and new values are updated. A decision regarding the differentiation of abnormally hot rail car surfaces and normally hot rail car surfaces is taken in step 266. If value of R×L is less than F, then the decision threshold, Θ, is increased in step 268, where R is a rate at which an alarm for hot bearing detection is generated, and F is a number of decisions for an abnormally hot rail car surface within the FIFO window. If R×L is greater than F, the decision threshold is decreased in step 270. If it is equal, the decision threshold is maintained constant.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for detecting a moving hot bearing or wheel of a rail car comprising:

a summer configured to combine an input signal representative of radiation emitted by the moving hot rail car bearing or wheel with a feedback signal to provide an error resulting from the combination of the input signal and the feedback signal;

a saturation module configured to determine a rank value of the input signal by comparing a current estimated rank value of the system to the error;

an integrator configured to accumulate the error, by adjusting the current estimated rank value such that the rank value of the input signal approaches a desired rank value, to provide an output signal;

a feedback loop configured to feedback the output signal to the summer as the feedback signal; and a detection module configured to detect a temperature of the bearing or wheel based on the output signal.

2. The system of claim 1, further comprising a gain block upstream of the integrator and configured to multiply the error by a desired gain value.

3. The system of claim 2, further comprising an offset block upstream of the integrator and configured to add an offset value to the error.

4. The system of claim 1, wherein the saturation module includes a comparator.

5. The system of claim 1, further comprising a multiple delay block upstream of the summer.

6. The system of claim 1, further comprising a non-linear operator upstream of the summer and configured to transform the input signal via a non-linear operation prior to combining the input signal with the feedback signal.

7. The system of claim 1, wherein the summer, the integrator, the saturation module, and the feedback loop are implemented in the analog domain.

8. The system of claim 1, wherein the summer, the integrator, the saturation module, and the feedback loop are implemented by appropriate programming of a digital processor.

9. The system of claim 1, wherein the summer, the integrator, the saturation module, and the feedback loop are implemented by combination of analog elements and appropriate programming of a digital processor.

10. The system of claim 1, further comprising sensors disposed adjacent to a rail for detecting the radiation emitted by the moving hot rail bearing or wheel.

11. The system of claim 1, further comprising communications circuitry configured to communicate an alarm signal to a remote monitor when the detection module detects that the bearing or wheel temperature is in excess of a desired value.

12. The system of claim 11, wherein detection module compares the output signal to a threshold signal to determine whether the temperature of the bearing or wheel is in excess of the desired value.

13. The system of claim 10, wherein the threshold signal is set by an adaptive algorithm.

14. A system for detecting a moving hot bearing or wheel of a rail car comprising:

a pass filter configured to receive an input signal representative of radiation emitted by the moving hot bearing car bearing or wheel, wherein the filter includes:

a multiple delay block configured to receive the input signal representative of radiation emitted by the moving hot rail car bearing or wheel, and to discretize the input signal with respect to time;

a summer configured to combine the discretized input signal with a feedback signal to provide a error resulting from the combination of the discretized input signal and the feedback signal;

a saturation module configured to determine a rank value for the discretized input signal by comparing a current estimated rank value of the system to the error;

an intergrator configured to accumulate the error, by adjusting the current estimated rank value such that the rank value of the discretized input signal approaches a desired rank value, to provide an output signal indicative of a temperature state of the bearing or wheel; and a feedback loop configured to feedback the output signal to the summer as the feedback signal; and detection module configured to detect the temperature state of the bearing or wheel based on the output signal.

15. The system of claim 14, the filter further comprising a gain block configured to multiply the discretized input signal by a fixed gain value.

16. A method for detecting a moving hot bearing or wheel of a rail car comprising:

receiving an input signal representative of radiation emitted by the moving hot rail car bearing or wheel;

combining the input signal with a feedback signal to generate an error;

determining a rank value of the input signal by comparing a current estimated rank value to the error;

accumulating the error, by adjusting the current estimated rank value such that the rank value of the input signal approaches a desired rank value, to produce an output signal;

feeding back the output signal as the feedback signal for combination with the input signal; and determining whether a temperature of bearing or wheel is in excess of a desired value based on the output signal.

17. The method of claim 16, further comprising multiplying the error by a desired gain value prior to accumulating the error.

18. The method of claim 16, further comprising combining the error with an offset value prior to accumulating the error.

19. The method of claim 16, further comprising introducing one or more delays in the input signal prior to combining of the input signal with the feedback signal.

20. The method of claim 16, further comprising transforming the input signal via a non-linear operation prior to combining the input signal with the feedback signal.

21. The method of claim 16, further comprising communicating an alarm signal to a remote monitor when it is determined that the bearing or wheel temperature is in excess of the desired value.

* * * * *